US008521344B2

(12) United States Patent
Bonanni

(10) Patent No.: US 8,521,344 B2
(45) Date of Patent: Aug. 27, 2013

(54) SYSTEM AND METHOD FOR GENERATING A ROUTE NAVIGATION DATABASE

(75) Inventor: Pierino Gianni Bonanni, Loudonville, NY (US)

(73) Assignee: General Electric Company, Niskayuna, NY (US)

( * ) Notice: Subject to any disclaimer, the term of this patent is extended or adjusted under 35 U.S.C. 154(b) by 1205 days.

(21) Appl. No.: 12/248,180

(22) Filed: Oct. 9, 2008

(65) Prior Publication Data

US 2010/0094551 A1 Apr. 15, 2010

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl.
USPC ..... 701/19

(58) Field of Classification Search
USPC ..... 701/1, 19–20, 23–26, 204–210, 213; 340/988–994, 995.1–995.28
See application file for complete search history.

(56) References Cited

U.S. PATENT DOCUMENTS

| | | | | |
|---|---|---|---|---|
| 4,173,073 | A * | 11/1979 | Fukazawa et al. | 33/1 Q |
| 5,740,547 | A * | 4/1998 | Kull et al. | 701/19 |
| 6,631,322 | B1 * | 10/2003 | Arthur et al. | 701/211 |
| 6,804,621 | B1 * | 10/2004 | Pedanckar | 702/94 |
| 7,130,753 | B2 * | 10/2006 | Pedanekar | 702/94 |
| 7,188,341 | B1 | 3/2007 | Hawthorne et al. | |
| 8,180,590 | B2 * | 5/2012 | Szwilski et al. | 702/150 |
| 2001/0047241 | A1 * | 11/2001 | Khavakh et al. | 701/209 |
| 2003/0078726 | A1 * | 4/2003 | Fukushima et al. | 701/209 |
| 2003/0222981 | A1 * | 12/2003 | Kisak et al. | 348/148 |
| 2005/0253926 | A1 | 11/2005 | Chung et al. | |
| 2007/0219680 | A1 * | 9/2007 | Kumar et al. | 701/19 |
| 2008/0306641 | A1 * | 12/2008 | Matusiak et al. | 701/19 |
| 2009/0177401 | A1 * | 7/2009 | Otsubo et al. | 702/5 |
| 2009/0248289 | A1 * | 10/2009 | Tanaka et al. | 701/200 |

OTHER PUBLICATIONS

Mirabadi et al., "Design of Fault Tolerant Train Navigation Systems," Proceedings of the American Control Conference, San Diego, CA, Jun. 1999, pp. 104-108.

* cited by examiner

*Primary Examiner* — Khoi Tran
*Assistant Examiner* — Harry Oh
(74) *Attorney, Agent, or Firm* — Scott J. Asmus

(57) ABSTRACT

A computer-readable storage medium having stored thereon a computer program including instructions, which, when executed by a computer, cause the computer to acquire route data in a first format for a route, the route data comprising a plurality of route parameters for a plurality of route locations. The computer is further programmed to re-format the acquired route data in the first format into a second format different from the first format, filter the reformatted route data into a route dataset having a lesser number of route locations than the number of route locations in the acquired route data, and to store the route dataset in computer memory.

18 Claims, 7 Drawing Sheets

100

FIG. 3

| BEGIN_MP | END_MP | GRADE |
|---|---|---|
| 153.218 | 153.343 | 0.2128 |
| 153.343 | 153.481 | 0.08613 |

102 106 108 104

110

FIG. 4

| BEGIN_MP | END_MP | GRADE |
|---|---|---|
| 153.218 | 153.343 | 0.2128 |
| 153.392 | 153.481 | 0.08613 |

112 116 118 114

120

FIG. 5

| BEGIN_MP | END_MP | GRADE |
|---|---|---|
| 153.218 | 153.343 | 0.2128 |
| 153.307 | 153.481 | 0.08613 |

122 126 127 128 124 129

SYSTEM AND METHOD FOR GENERATING A ROUTE NAVIGATION DATABASE

BACKGROUND

1. Technical Field

The invention includes embodiments that relate to a navigation database system. The invention includes embodiments that relate to a method of using the navigation database system.

2. Discussion of Art

In operating a vehicle, such as a locomotive or an off-highway vehicle, some of the factors that an operator may take into account include environmental conditions, grade or slope, track or path curvature, speed limits, vehicle size, weight of the cargo, and the distribution of that weight.

An automatic train control system having, for example, a navigation system and a pacing system may benefit from a database that depicts track or path features and locations. Generating this database may be problematic. Additionally, such databases, when complete, may require systems with considerable data storage capabilities.

It may be desirable to have a system that has aspects and features that differ from those systems that are currently available. It may be desirable to have a method that differs from those methods that are currently available.

BRIEF DESCRIPTION

According to an aspect of the invention, a computer-readable storage medium having stored thereon a computer program that includes instructions, which, when executed by a computer, cause the computer to acquire route data in a first format for a route, the route data comprising a plurality of route parameters for a plurality of route locations. The computer is further programmed to re-format the acquired route data in the first format into a second format different from the first format, filter the re-formatted route data into a route dataset having a lesser number of route locations than the number of route locations in the acquired route data, and to store the route dataset in computer memory.

In accordance with another aspect of the invention, a method that includes obtaining survey data in a first format for a first route having a number of locations, the survey data comprising a plurality of route parameters for the number of locations. The method further includes assembling the survey data in the first format into a series of tables having a second format different from the first format, reducing the number of locations in the survey data for the first route based on a set of criteria, and storing the reduced number of locations in computer memory.

In accordance with another aspect of the invention, a navigation database system comprising a computer programmed to receive survey data in a first format for a route, the survey data comprising a plurality of route parameters for a plurality of locations in the route. The computer is further programmed to convert the received survey data into a second format different from the first format, process the converted survey data into a dataset having fewer locations in the route than the plurality of locations in the route from the received survey data, and store the dataset in computer memory.

Various other features will be apparent from the following detailed description and the drawings.

BRIEF DESCRIPTION OF THE DRAWINGS

The drawings illustrate an embodiment of the invention. For ease of illustration, a locomotive and track system has been identified, but other vehicles and vehicle routes are included except were language or context indicates otherwise.

FIG. 3 is a diagram showing a table having railroad track data.

FIG. 4 is a diagram showing a table having a having gap in the railroad track data.

FIG. 5 is a diagram showing a table having an overlap in the railroad track data.

DETAILED DESCRIPTION

The invention includes embodiments that relate to route navigation database systems. The invention includes embodiments that relate to methods for generating navigation database systems. The invention also includes embodiments that relate to generation of a route navigation database.

According to one embodiment of the invention, a computer-readable storage medium having stored thereon a computer program including instructions, which, when executed by a computer, cause the computer to acquire route data in a first format for a route, the route data comprising a plurality of route parameters for a plurality of route locations. The computer is further programmed to re-format the acquired route data in the first format into a second format different from the first format, filter the re-formatted route data into a route dataset having a lesser number of route locations than the number of route locations in the acquired route data, and to store the route dataset in computer memory.

In accordance with another embodiment of the invention, a method that includes obtaining survey data in a first format for a first route having a number of locations, the survey data comprising a plurality of route parameters for the number of locations. The method further includes assembling the survey data in the first format into a series of tables having a second format different from the first format, reducing the number of locations in the survey data for the first route based on a set of criteria, and storing the reduced number of locations in computer memory.

In accordance with yet another embodiment of the invention, a navigation database system comprising a computer programmed to receive survey data in a first format for a route, the survey data comprising a plurality of route parameters for a plurality of locations in the route. The computer is further programmed to convert the received survey data into a second format different from the first format, process the converted survey data into a dataset having fewer locations in the route than the plurality of locations in the route from the received survey data, and store the dataset in computer memory.

Figure 1:
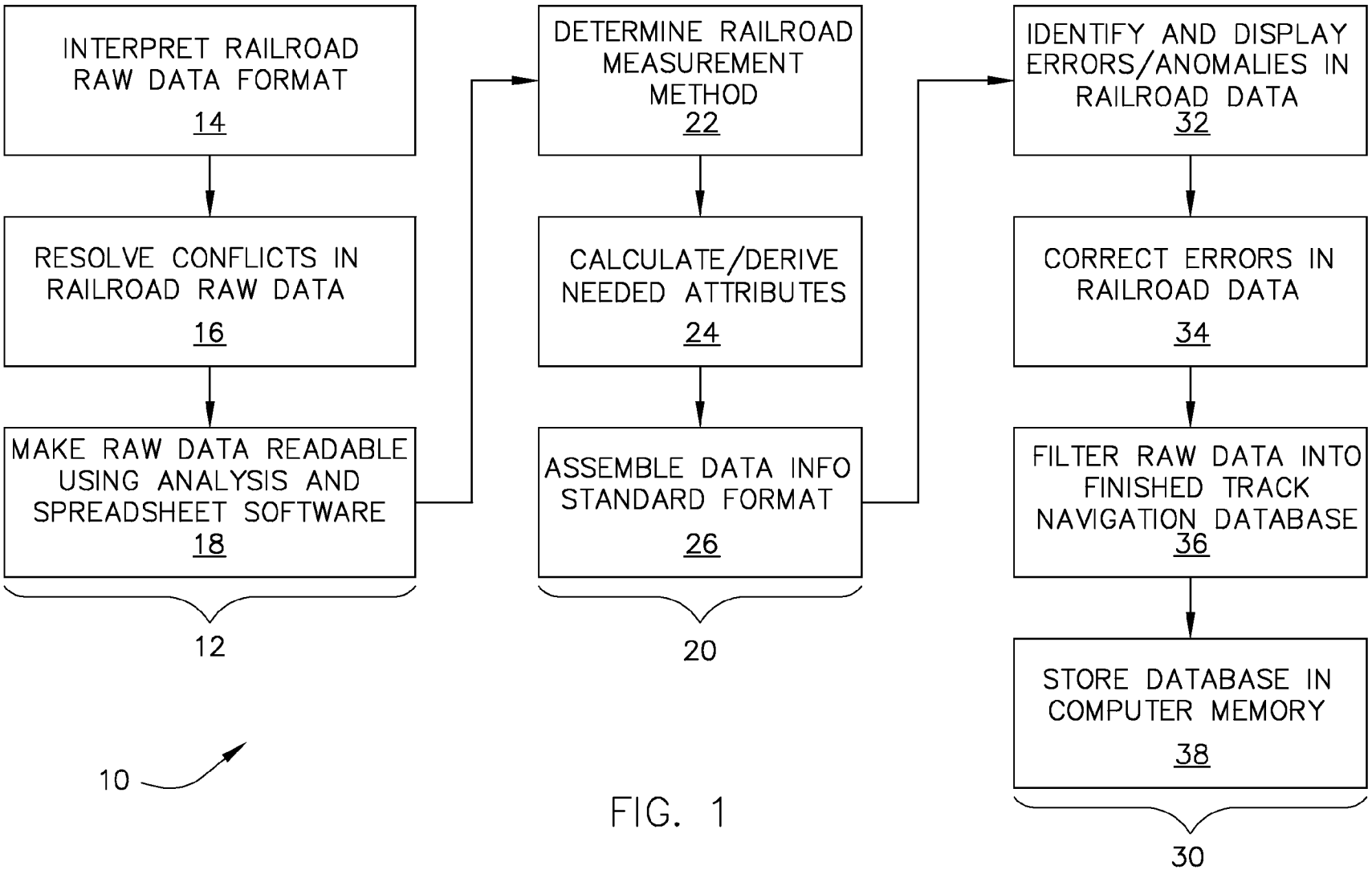
FIG. 1 is a flowchart showing a technique for generating a track navigation database according to an embodiment of the invention.

In one embodiment, a flowchart showing a technique 10 for generating a track navigation database according to an embodiment of the invention is shown in FIG. 1. Technique 10 may be programmed into a computer (not shown), which may be part of a track navigation database system. The track navigation database system may be part of a vehicle, such as a locomotive, and may serve to prepare, format, and use data to automatically drive or operate the vehicle. Technique 10 includes an extraction process 12 for distilling route parameters from raw survey data in the railroad's native format. The extraction steps 12 include acquisition and interpretation of raw survey data acquired from a railroad company regarding data along one or more routes 14. The raw data may include information such as, latitude, longitude, track curvature, elevation, grade, milepost locations, and speed limit along the route. Acquisition of survey data may involve receiving railroad survey data in electronic or in text form, or it may involve acquiring the data via a global positioning system (GPS) survey. Survey data may be stored in an electronic database or may even be stored in a printed form. In the case where the raw data is stored in printed form, entry of that data into electronic form may be achieved through user entry or optical character recognition, for example.

In addition, the format for storing the raw survey data may differ from company to company, or from system to system. For example, the data for an entire railroad network, having multiple subdivisions or routes, may be aggregated in one file, in which case the extraction process 12 might involve applying a filter to the aggregate data to extract only the data for the route being processed. In other cases, a railroad may have the data referring to one section of track in several files. For example, if the section of track was surveyed over a period of days, there might be a separate file for each day a survey was performed. In another example, certain parameters, such as latitude, longitude and grade may be stored in one file while speed limits, track curvature and milepost locations are stored in a separate file. In cases where the survey data is scattered among multiple files, to generate a complete navigation database for the entire route, the extraction process 12 might involve combining data from the separate files to acquire and interpret the desired route parameter data.

The second step in the extraction process 12 calls for the resolution of conflicts in the raw data from the railroad 16. Conflicts in the raw data may take the form of non-plausible or missing parameter values in electronic data, for example. Conflict resolution may involve a comparison of the electronic data with printed railroad track charts or time tables to verify, for example, non-plausible parameter values. Similarly, for those cases in which the electronic data contains gaps or missing information, it may be necessary to consult railroad track charts or time tables to obtain the missing information. Another type of conflict in the raw data involves a lack of agreement between the data. For example, the latitude and longitude data for a section of track should agree with the track curvature data for the section. If there is a lack of agreement in the raw data, further analysis of the data or consultation with railroad personnel may be required to determine the source of the error.

The third step in the extraction process 12 calls for making the raw survey data readable to spreadsheet-type software and mathematical analysis software 18. By manipulating the raw data such that the data can be organized and displayed in spreadsheet form, the data can then be standardized during build steps 20.

The build steps 20 refer to the assembly of the raw survey data into a series of standardized database spreadsheets or tables, and may involve converting the survey data from one of several possible railroad formats into a second format that can be easily processed by the navigation database system. As shown in FIG. 1, build steps 20 include making a determination of the location measurement method used by the railroad 22, deriving needed attributes from the raw data 24, and assembling the raw data into a standard format 26. In general, the extract 12 and build 20 steps must be customized each time a new format for the raw data is encountered.

A determination of the railroad measurement method 22 is used to create an accurate milepost map. For a variety of reasons, the posted milepost values along a particular route or section of track may not accurately represent the true distance between any two locations on the route. For example, an infrastructure change may result in a small section of track being eliminated or shortened. But typically, the railroad will not reset all of the mileposts to reflect a minor change to the track. However, several such changes may occur over time further decreasing the accuracy of the posted milepost values. To account for these inaccuracies, railroads may develop a set of milepost equations. For example, railroad track data may indicate that milepost 3.0 equals 3.2, meaning that the distance between mileposts 3 and 4 is actually 0.8 miles instead of one mile. Furthermore, the railroad data may have more than one detailed mapping of the mileposts and their distances from a reference point on the route under consideration. Depending on the methods used to generate the mappings, there may not be complete agreement among the various milepost maps. An assessment of the available milepost maps may be needed to choose the one with the highest degree of accuracy.

In an alternative embodiment of the invention, distances between mileposts may be calculated to generate a milepost map. The distances between mileposts may be generated from longitude and latitude milepost data together with parameter data such as longitude, latitude, grade, and/or elevation data for locations along the route between the mileposts. Such data may be available from the railroad or may be acquired via a GPS survey. The parameter data, in one embodiment, includes data acquired every 20 to 100 feet along the route. With the latitude, longitude, and elevation data for a sufficient number of route locations, including milepost locations, the distance between mileposts can be calculated. In one embodiment, the distances are calculated using one or more computer programs configured for such a purpose. The one or more computer programs could include models of the Earth to increase an accuracy of the distance calculations as the route travels along the surface of the Earth. The Earth models may model the Earth as a perfect sphere or as an oblate spheroid. Distances in the calculated milepost map may be used to substitute or corroborate the distance data acquired from a railroad. Alternatively, the calculated milepost map may be generated when distance data from a railroad is not available.

Figure 2:
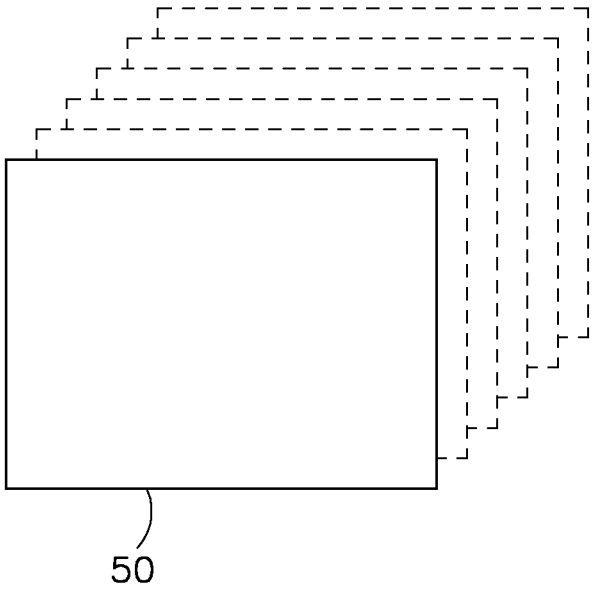
FIG. 2 is a block diagram showing a set of track database spreadsheets according to an embodiment of the invention.

In an embodiment of the invention illustrated in FIG. 2, a series of track database (TDB) spreadsheets, or tables, 50 is generated from the extract 12 (shown in FIG. 1) and build 20 (shown in FIG. 1) steps. TDB spreadsheets 50 provide a human-readable standardized format to support automated building of track databases. Some of the values in the TDB spreadsheets may be calculated or derived based on the survey data provided by the railroads. Entries may be color coded to indicate that any values that have been calculated or derived, as in step 24 (shown in FIG. 1), may not be directly editable in the TDB spreadsheets 50 in which they are listed. For example, calculated or derived values may be shown with their numbers in gray (rather than black) to show indicate that the values cannot be edited, at least not directly. Editing the raw survey data may correspondingly change the calculated values. For example, distances may be calculated in feet based on milepost locations. Also, the beginning point and end point of a curved section of track may be shown in feet based on milepost locations. The calculated values may be shown in gray in columns adjacent to the milepost locations shown in black and provided in the survey data.

A general rule for TDB spreadsheets 50 is that, for any particular column of data, distance along the route increases from the route starting point to the route end point as one proceeds down the column. That is, the top row of a column would include the route starting point, while the last row of the column would include the route end point. Proceeding down the column row-by-row is analogous to traveling along the route. It is noted that the milepost name or identifier may increase or decrease depending on the direction of travel. That is, a particular milepost at one end of the route may indicate the starting milepost or the ending milepost depending on the direction of travel.

In an embodiment of the invention, a separate spreadsheet is constructed for each of track curvature, land grade, speed limit, terrain, geometry, and milepost location. As an example, spreadsheets 50 may be stored in a file in which each spreadsheet is a separate tab or worksheet entitled "curve," "grade," "speed," "terrain," "geometry," and "milepost."

In an embodiment of the invention, the curve spreadsheet may include a plurality of rows, wherein each row defines a track interval over which the curvature value, shown in units of degrees per 100 feet of track, is assumed to be constant. For example, a first curvature for a track interval may be shown on one row while a second curvature for a succeeding track interval may be shown on the next row. Accordingly, each track interval may occupy one row of the spreadsheet and may show a starting and an ending milepost value along with a starting and ending point shown in feet as a distance from the route starting point for the track interval on the row.

In an embodiment of the invention, the grade spreadsheet contains longitudinal grade information in units of percent, wherein a positive value indicates a rising elevation in the direction of travel. The grade value is calculated base on the elevation values of a series of successive points or locations. The grade spreadsheet also lists a transverse super-elevation in inches, or alternatively in percent, with positive values indicating a higher elevation on the port side of the train.

In an embodiment of the invention, the speed spreadsheet generally lists the speed limits and speed limit type for the route locations listed in the spreadsheet. Route locations in the speed spreadsheet may be shown as milepost locations. Speed limits may be shown in miles per hour, for example, and speed limit types may be shown as "0" for a full train and "1" for the head-end only, for example.

In an embodiment of the invention, the terrain spreadsheet contains only calculated values so that all column values are shown in gray. Typically, the terrain spreadsheet merges the information from the information from the curvature, grade, and speed spreadsheets and may be provided solely for the benefit of a human reader desiring one view of the track topography.

In an embodiment of the invention, the geometry spreadsheet includes latitude and longitude of the series of locations that define a route which follows a railroad track centerline. The latitudes and longitudes are recorded as a function of milepost locations along the route and as a function of distance in feet from a starting point.

In an embodiment of the invention, the milepost map spreadsheet shows the true milepost location as a function of distance along the route. Certain features of the route, such as speed limits, may be specified with respect to posted mileposts. That is, speed limit changes may take effect at milepost locations. Therefore, it is important that an automatic train control system has a reliable method for determining milepost locations. However, the value shown on a particular milepost may not be an accurate enough measure of the actual milepost location (i.e. an accurate measure of the milepost distance from a reference point) for the purposes of an automatic train control system. Consequently, a milepost map is constructed to show the actual location of each milepost to a degree of accuracy requested by the control system. As described above, the values in the milepost map spreadsheet, when listing milepost marker information from a route start to a route end, may show a higher-numbered milepost identifier at the route start than the milepost identifier at the route end due to direction of travel.

Referring again to FIG. 1, after assembling the data into a standard format 26, a series of survey data processing steps 30 reduce and refine the raw data into a usable final form. Process steps 30 include an error-checking process 32 in which errors and/or anomalies in the raw data are identified for correction. Automated error-checking includes identifying errors and anomalies in the raw data that may compromise the performance of an automatic train control system relying on the data in TDB spreadsheets 50.

Some route parameters may be applied to track intervals rather than one specific point along the route. For example, track curvature or grade values may be assigned to a track interval with starting point A and ending point B, where A and B are the distances, in feet or miles, from a reference point. A TDB spreadsheet 50 for curvature or grade includes a list of the curvature or grade values along with associated starting and ending points. FIG. 3 illustrates an example of a table in such a spreadsheet. For the track information to be considered complete, the starting point for each track interval should equal the ending point of the preceding interval. In table 100, a first track segment 102 has an ending milepost value 104 with the same value (e.g., 153.343) as a beginning milepost value 106 for a second track segment 108.

If the starting point for a track interval in the grade spreadsheet is a value greater than the ending point of the previous interval, there is a gap in the raw grade data. This gapped area is a track interval for which the grade is not defined. FIG. 4 shows a table 110 having a gap in the grade data. In table 110, a first track segment 112 has an ending milepost value 114 (e.g., 153.343) that is less than the value (e.g., 156.392) for a beginning milepost value 116 for a second track segment 118. As a result, no grade information exists for the track segment between milepost values 153.343 and 153.392. Upon identifying a gap, such as shown in FIG. 4, technique 10 displays the gap to a user. For example, the pair of rows in the TDB spreadsheets 50 between which the gap has been identified may be highlighted to the user. In addition or alternatively thereto, it is contemplated that a graphical user interface (GUI) may be displayed to the user illustrating a representation of the track segment along with a representation of the affected parameters or locations.

FIG. 5 illustrates an example of a table having an overlap error in raw grade data. An overlap exists if the starting point for a track interval in the grade spreadsheet is a value less than the ending point of the previous interval, there is an overlap in the grade data. This overlapped area is a track interval for which the grade may be ambiguous since it is defined on two different lines or rows in the spreadsheet. In table 120, a first track segment 122 has an ending milepost value 124 (e.g., 153.343) that is greater than the value (e.g., 156.307) for a beginning milepost value 126 for a second track segment 128. Because the grade value 127 for first track segment 122 (e.g., 0.2128) is different from the grade value 129 for second track segment 128 (e.g., 0.08613), the grade value for a portion of track from milepost value 153.307 to 153.343 is ambiguous as this portion of track is included in both first and second track segments 122, 128. Upon identifying an overlap, such as that shown in FIG. 5, technique 10 displays the overlap to a user. For example, the pair of rows in the TDB spreadsheets 50 between which the overlap has been identified may be highlighted to the user. In addition or alternatively thereto, it is contemplated that a graphical user interface (GUI) may be displayed to the user illustrating a representation of the track segment along with a representation of the affected parameters or locations.

Figure 6:
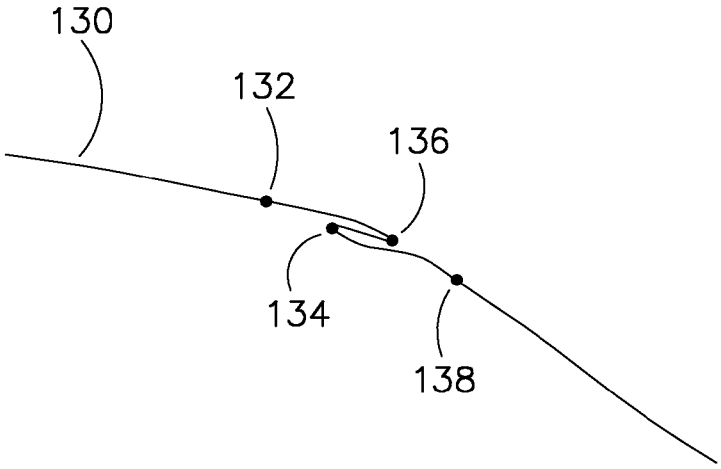
FIG. 6 is a diagram showing non-sequentially ordered locations in a railroad track route.

FIG. 6 illustrates an example of a route 130 having incorrectly ordered locations, that is, having successive or sequential locations that are not listed sequentially. A route 130 is illustrated having four successive locations 132, 134, 136 and 138. In the example shown, locations 134 and 136 have been transposed in the raw data such that the route 130 depicted proceeds from location 132 to location 136. Route 130 then makes an abrupt reversal in direction to location 134 before proceeding to location 138. Technique 10 may identify the reversal in direction based on a heading calculated from the two locations preceding the current location. A reversal detected in this manner is displayed to the user via the TDB spreadsheet 50 or GUI as described above.

Figure 7:
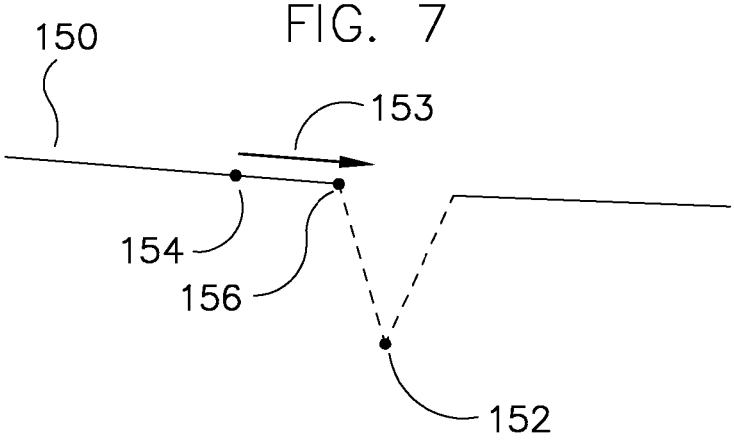
FIG. 7 is a diagram showing a spurious location in a railroad track route.

FIG. 7 illustrates an example of a route 150 containing a spurious location or point 152, which does not properly belong in the route. A spurious location 152 in railroad track data may have several possible causes. A data entry error may result in the incorrect route parameters being associated with a location. Likewise, a GPS equipment malfunction during the recording of survey data could also cause a spurious location 152 in the raw data. In an embodiment of the invention, a spurious point or location 152 is defined as a point that deviates from a calculated heading 153 by more than a threshold amount. The heading 153 may be calculated by extrapolating a path from two successive locations 154, 156 prior to spurious location 152. It can be seen from FIG. 7 that the path from location 156 to spurious location 152 deviates significantly from calculated heading 153. Such deviations may be identified by technique 10 and displayed to the user.

Figure 8:
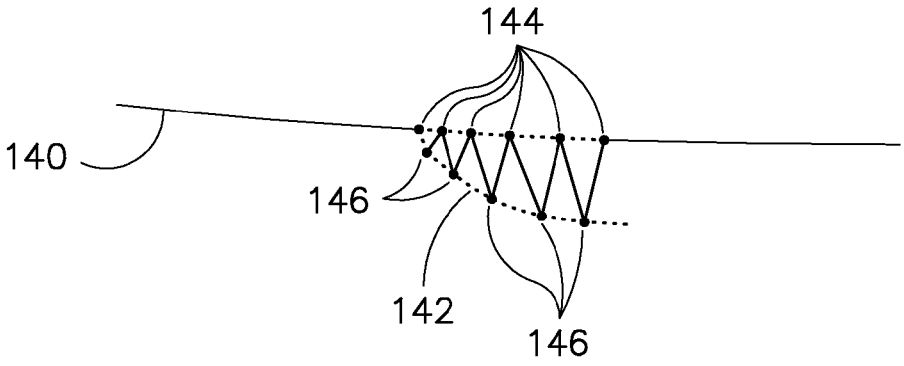
FIG. 8 is a diagram showing parallel track locations in a railroad track route.

FIG. 8 illustrates an example of a route 140 with two diverging paths, one of which includes the locations of a railroad track siding 142 (shown in phantom). This may cause some confusion, as the raw data may be interpreted as having the additional track siding locations as a single route. The resulting route pattern, shown in FIG. 8, is one where the successive locations alternate between locations 144 along the intended route and locations 146 on the track siding 142. Route generation errors due to incorporation of track siding locations 146 may be identified using the same method described above to identify spurious locations. In an embodiment of the invention, technique 10 identifies a deviation from a calculated heading by more than a threshold amount, the calculated heading based on the two successive locations prior to the current location. After identification, the identified section of track 140 having track siding 142 is displayed to the user.

Referring again to FIG. 1, errors and/or anomalies in the railroad data that have been identified 32 and displayed may be corrected 34 by the user or automatically. The method of correction may vary with the type or error. For example, with respect to a route having a spurious location, the navigation database system may be programmed to eliminate the spurious location automatically or after a user input. Alternatively, the user could specify on the display the spurious point to be eliminated. Similarly, a route having track siding that has been erroneously incorporated into the route may be corrected 34 when the user or technique 10 automatically eliminates from the route those locations belonging to the track siding. Either the user or a suitably programmed navigation database system could correctly order non-sequentially ordered locations.

Gaps in grade, curvature or speed limit data resulting from a beginning milepost location value for a track interval having a greater value than the ending milepost location value for the preceding interval may lead to further analysis of the raw data to determine if an obvious error exists. Further, such a gap may lead to analysis of alternate sources of railroad data where such a gap in the grade, curvature or speed limit data does not exist. Correction of an overlap in the milepost location data may be handled in the same way. Analysis of the railroad data or the use of alternate sources of data may provide as solution to the overlap error identified by the track navigation system.

Identifying errors in the railroad also includes identifying locations with missing route parameters, zero-length distance intervals between mileposts, and distance or milepost repetitions or reversals (i.e., violation of the general rule that distance increases from one location to the next along the route). As with the data errors described above, corrective action may be implemented by the user or by a suitably programmed navigation database system.

Referring back to FIG. 1, after any railroad data has been corrected 34, the raw data locations are filtered to eliminate a number of locations 36, while retaining a sufficient number of locations to accurately define the routes in the railroad network. Eliminating locations reduces the amount of route data and, therefore, the amount of data storage and processing power needed by an automatic train control system to use the route data. According to an embodiment of the invention, an adaptive point spacing protocol is used to determine which locations should be kept and which locations can be eliminated. An adaptive point spacing protocol according to an embodiment of the invention may be configured to obey three criteria: 1) the maximum point spacing is a predetermined value, for example, one mile; 2) on curved sections of track, the chordal error is less than a chordal error threshold; and 3) an avoidance of connectivity ambiguities due to track foldback.

Figure 9:
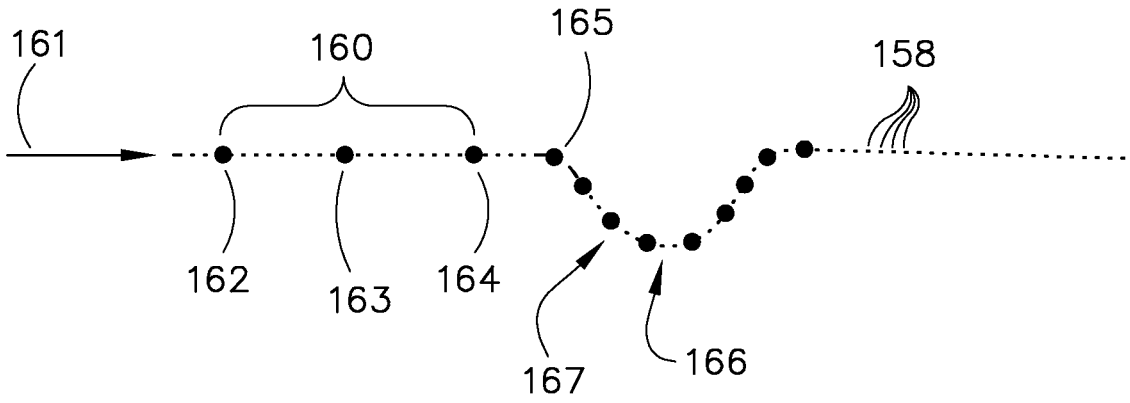
FIG. 9 is a diagram showing an adaptive point spacing on a straight and curved section of a railroad track route according to an embodiment of the invention.

In an embodiment of the invention, the TDB spreadsheets 50 (shown in FIG. 2) are configured to accept raw data having location or point spacings of no less than three feet and no more than 100 feet. However, uniform spacing of locations is not required. FIG. 9 graphically shows locations 158 of a portion of a straight track segment 160 of a route 161 derived from the raw data in TDB spreadsheets 50 after any corrections to the raw data have been made. In this example, the adaptive point spacing eliminates all points 158 in segment 160 except for points 162-165 according to a one-mile maximum point spacing criterion. As shown, the section of track segment 160 between points 162 and 164 is a straight two miles. Accordingly, point 163 is not eliminated such that the two-mile segment between points 162 and 164 obeys the one-mile maximum point spacing criterion. Further, point 165 is located at an end of straight track segment 160 and represents a change from straight portion 160 to a curved portion 166 of route 161. A distance between points 164 and 165 satisfies the one-mile maximum point spacing criterion since the distance is less than one mile. The locations 158 between points 164 and 165, however, are eliminated. The maximum spacing criterion is adhered to on all track geometries including straight and curved sections of track. The spacing criterion ensures that the automatic train control system receives sufficiently frequent updates from the track navigation database allowing for error correction due to imprecise speed integration.

Figure 10:
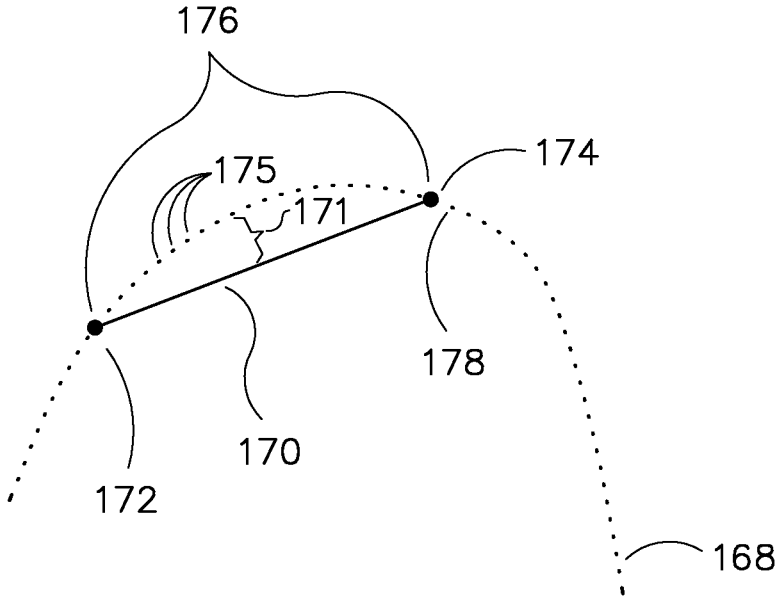
FIG. 10 is a diagram showing chordal error on a curved section of track.

FIG. 10 illustrates an example of a chordal error determination for a curved segment 168 of track. Chordal error is the maximum distance between a chord or line 170 joining two successive points 172, 174 on a curved section of track 168 and points 175 of an arc 176 of the curved segment 168 between the two successive points 172, 174. For example, the chordal error threshold for a curved section of track may be 20 feet. Line 170 connects two successive points 172, 174, and a distance 171 between line 170 and points 175 between points 172, 174 is determined. To be within the threshold, the distance 171 from chord 170 to arc 176, measured at a right angle from the chord 170, must be within 20 feet anywhere along the chord. If all distances 171 between chord 170 and arc 176 satisfy the chordal error threshold for points 172 and 174, chord 170 may be moved to another set of points, 172, 178, to measure distances 171 from chord 170 to points 175 between points 172, 178. If, for example, a distance 171 in the chord 170 (between points 172, 178) and points 175 results in a distance greater than the chordal error threshold, point 174 may be kept while the points 175 between points 172, 174 may be eliminated. The chordal error threshold criterion ensures that, after filtering, the database representation of the route is a reasonably close approximation of the actual route. In general, the chordal error criterion results in points or locations 167 (shown in FIG. 9) more closely spaced (i.e., fewer points eliminated) on curved sections of track 166 (shown in FIG. 9) than on straight sections.

The ambiguity avoidance criterion ensures that, for any segment on the actual track, ambiguity is avoided anywhere along the segment as to the locations of the segment end points. The automatic train control system is able to accurately fix the location of the train at any point in time. One of the ways the system determines location is by calculating the distance to the nearest point in the filtered track navigation database. The ambiguity avoidance criterion helps to reduce confusion that might occur within the automatic train control system in mountainous or other regions where the track can loop back on itself.

Figure 11:
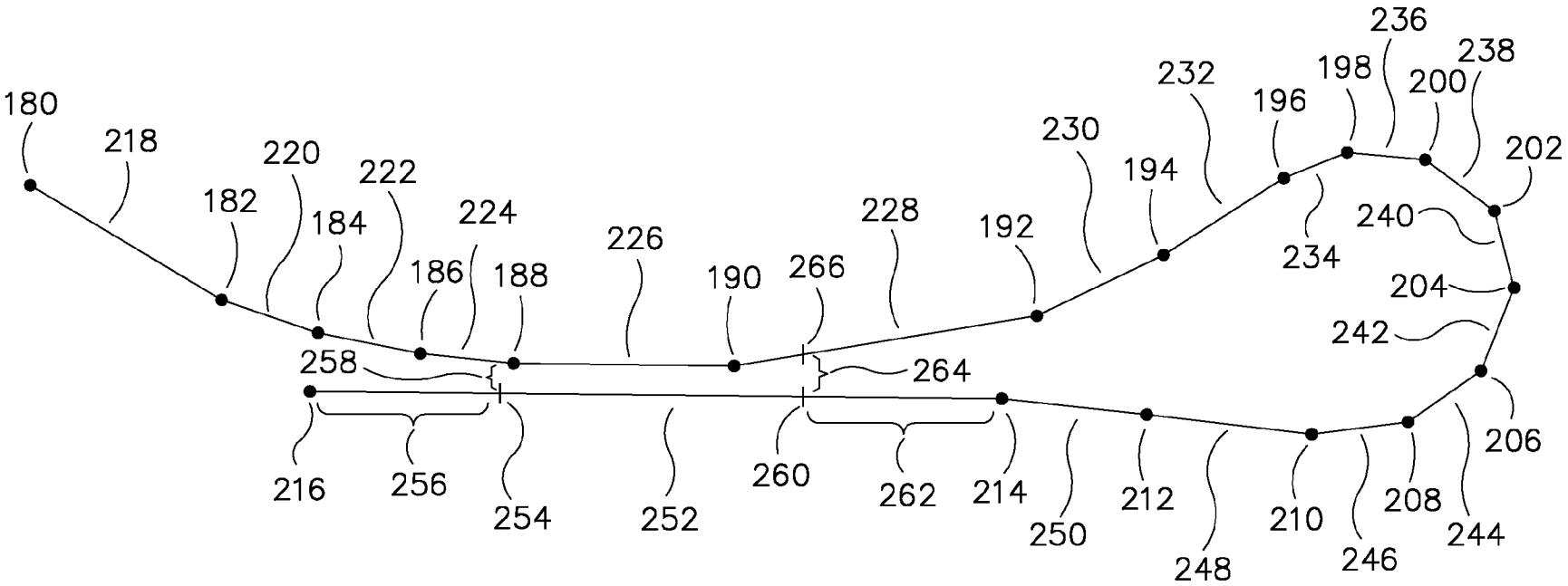
FIG. 11 is a diagram showing improper point spacing on a railroad track route having looped back section of track according to an embodiment of the invention.

FIG. 11 shows an example of a looped-back track portion 180 having a plurality of points 180-216 remaining after application of the maximum point spacing and chordal error criteria of the adaptive point spacing protocol according to an embodiment of the invention. A plurality of segments 218-252 extend between points 180-216. That is, each pair of adjacent points, 186 and 188 or 190 and 192, for example, is a pair of end points having a corresponding track segment 224 or 228, for example, extending therebetween. The ambiguity avoidance criterion ensures that, for any position along the length of any one segment, the distance to either of the segment end points is less than the distance of that position to any portion of any non-adjoining or non-contiguous segment.

FIG. 11 illustrates an example in which the point spacing does not obey the ambiguity avoidance criterion. In this example, a segment 252, which has end points 214 and 216, obeys the maximum point spacing criterion. However, at a position 254 along segment 252, a distance 256 to the nearest end point 216 is greater than a distance 258 to point 188 of segment 224. In this case, when the automatic train control system locates the train at position 254, in trying to determine the location of the train, searches for the nearest end point, it may find point 188 instead of point 216. Similarly, at a position 260 along segment 252, a distance 262 to the nearest end point 214 is greater than a distance 264 to a position 266 along segment 228. As above, the automatic train control system locating the train at position 260, may find a position, such as position 266, along segment 228 to be closer than end point 214 when searching for the nearest end point. In each of these examples, as a result of an inability to determine the end point of the correct segment in which the train is located, the automatic train control system may cease to function properly or may not operate the train as intended. To obey the ambiguity avoidance criterion, points should be added to segment 252. Just as there are positions along segment 252 that are closer to positions along segments 224, 226 and 228 than to end points 214 and 216, the reciprocal is also true in this example. That is, there are positions along segments 224, 226 and 228 that are closer to positions along segment 252 than to end points 186-192. To obey the ambiguity avoidance criterion, points should also be added to segments 224, 226 and 228.

Figure 12:
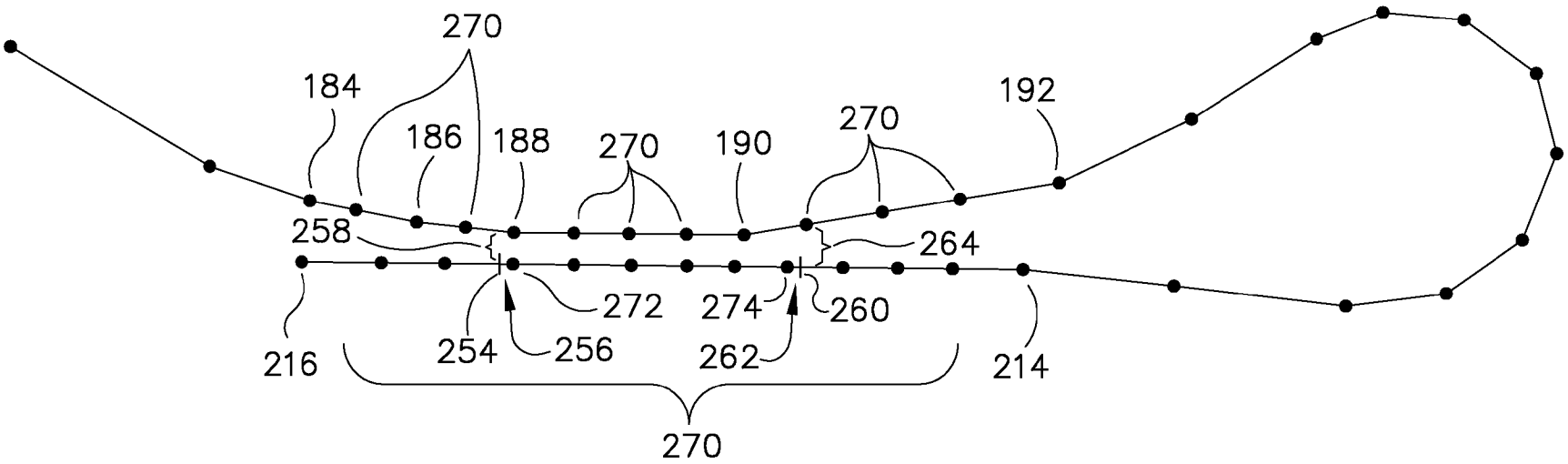
FIG. 12 is a diagram showing proper point spacing on a railroad track route having looped back section of track according to an embodiment of the invention.

FIG. 12 illustrates an example of adaptive point spacing in which the points obey the ambiguity avoidance criterion. For any position on any segment of track, the ambiguity avoidance criterion ensures that the distance to the nearest end point on that segment is less than the distance to the nearest position on any other segment of track. Showing the same looped-back section of track shown in FIG. 11, a plurality of points 270 have been added to track portion 180. With points 270 added, FIG. 12 illustrates that positions 254 and 260 are no longer closer to another track section than their respective section endpoints. The distance 256 from position 254 to the nearest endpoint 272 is less than the distance 258 to the nearest position, point 188, on a non-contiguous section of track. Similarly, the distance 262 from position 260 to the nearest endpoint 274 is less than the distance 264 to the nearest position, one of the plurality of points 270, on a non-contiguous section of track.

Referring again to FIG. 1, after the filtering process 36 is complete, the track navigation database is complete and ready for storage in computer memory 38, where it can be accessed by an automatic train control system. While an embodiment of the invention is described herein with respect to a system and method for generating a railroad network or track navigation database of the type that could be used in an automatic control system for a locomotive and its consist, one skilled in the art will recognize that embodiments of the invention may be used in modes of transport beyond those related to railroads and automatic control of locomotives. Additionally, while embodiments of the invention may be programmed and performed on a track navigation system computer, embodiments of the invention may also be performed independently of a track navigation system via a computing device such as a computer, PDA, or cell phone. In this manner, a track navigation system computer may access or store a completed track navigation database.

A technical contribution for the disclosed method and apparatus is that it provides for a computer configured to generate a railroad track navigation database.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not limited by the foregoing description, but is only limited by the scope of the appended claims.

What is claimed is:

1. A navigation database system comprising a computer programmed to:

acquire route data in a first format for a route, the route data comprising a plurality of route parameters for each of a plurality of route locations;

re-format the acquired route data in the first format into a second format different from the first format;

filter the re-formatted route data into a route dataset having a lesser number of route locations than the number of route locations in the acquired route data;

store the route dataset in computer memory;

identify a portion of the survey data wherein two successive locations of the number of locations in the first route are separated by a distance that is greater than a threshold multiple of the average distance between successive locations of the number of locations in the first route; and display the identified portion of the survey data to a user.

2. The navigation database system of claim 1, wherein the plurality of route parameters comprises one of a curvature parameter, a grade parameter, a speed limit parameter; and wherein the computer being programmed to re-format the acquired route data is further programmed to:

generate a separate table for each of the curvature parameter, the grade parameter, and the speed limit parameter, wherein each table includes respective data for one or more of the plurality of route locations.

3. The navigation database system of claim 2, wherein the computer being programmed to acquire route data in a first format is programmed to acquire route data having the plurality of route parameters for each of the plurality of route locations stored in one computer file.

4. The navigation database system of claim 1, wherein the plurality of route locations comprises a plurality of positions along the route wherein route data is acquired via a global positioning system (GPS) survey.

5. The navigation database system of claim 1, wherein the filtered route data comprise a plurality of positions along a straight portion of the route, and wherein a spacing between any two positions along the straight portion of the route is no more than one mile.

6. The navigation database system of claim 5, wherein the spacing between two positions along the straight portion of the route is one mile.

7. The navigation database system of claim 1, wherein the filtered data comprise a plurality of positions along a curved portion of the route, and wherein the spacing between any two of the plurality of positions along the curved portion is such that the chordal error is no more than a chordal error threshold.

8. The navigation database system of claim 1, wherein the filtered data comprise a plurality of positions along the route, and wherein the spacing between any two position is determined such that, for a track segment having two end points, wherein the two end points comprise two consecutive positions, the distance from a point on the segment to a nearest of the two end points is less than the distance from the point to any point on any non-contiguous track segment.

9. A method comprising:

obtaining survey data in a first format for a first route having a number of locations, the survey data comprising a plurality of route parameters for the number of locations;

assembling the survey data in the first format into a series of tables having a second format different from the first format;

reducing the number of locations in the survey data for the first route based on a set of criteria;

storing the reduced number of locations in computer memory;

identifying, via a processor, a portion of the survey data wherein two successive locations of the number of locations in the first route are separated by a distance that is greater than a threshold multiple of the average distance between successive locations of the number of locations in the first route; and displaying the identified portion of the survey data to a user.

10. The method of claim 9, wherein reducing the number of locations in the survey data comprises:

eliminating one or more locations on a straight portion of the first route such that remaining locations on the straight portion of the first route are no more than one mile apart;

eliminating one or more locations on a curved portion of the first route such that remaining locations on the curved portion of the first route yield a chordal error within a chordal error threshold; and determining a spacing for locations in the first route such that for a track segment having two end points, wherein the two end points comprise two consecutive locations of the number of locations, the distance from a point on the segment to a nearest of the two end points is less than the distance from the point to any point on any non-contiguous track segment.

11. The method of claim 9, further comprising:

identifying a portion of the survey data in which a location of the number of locations in the first route deviates from a calculated heading by more than a threshold amount, the calculated heading based on the previous two successive locations of the number of locations; and displaying the identified portion of the survey data to a user.

12. The method of claim 9, further comprising:

identifying a portion of the survey data in which a first path in the first route has a second path diverging therefrom; and displaying the identified portion of the survey data to a user.

13. The method of claim 12, further comprising:

identifying a portion of the survey data where successive locations of the number of locations in the first route are not listed sequentially; and displaying the identified portion of the survey data to a user.

14. A non-transitory computer-readable storage medium having stored thereon a computer program comprising instructions, which, when executed by a computer, causes the computer to:

receive survey data in a first format for a route, the survey data comprising a plurality of route parameters for a plurality of locations in the route;

convert the received survey data into a second format different from the first format;

process the converted survey data into a dataset having fewer locations in the route than the plurality of locations in the route from the received survey data;

store the dataset in computer memory;

identify a portion of the survey data wherein two successive locations of the number of locations in the first route are separated by a distance that is greater than a threshold multiple of the average distance between successive locations of the number of locations in the first route; and display the identified portion of the survey data to a user.

15. The non-transitory computer-readable storage medium of claim 14, wherein the instructions that cause the computer to receive survey data comprises instructions that cause the computer to:

receive a latitude parameter and a longitude parameter for one or more of the plurality of locations in the route; and receive milepost locations for each milepost in the route.

16. The non-transitory computer-readable storage medium of claim 15, wherein the plurality of route parameters comprises one of a curvature parameter, a grade parameter, and a speed limit parameter for each of the plurality of route locations.

17. The non-transitory computer-readable storage medium of claim 14, wherein the instructions that cause the computer to process the converted survey data comprises instructions that cause the computer to:

eliminate one or more locations on a straight portion of the route such that remaining locations on the straight portion of the route are no more than one mile apart;

eliminate one or more locations on a curved portion of the route such that remaining locations on the curved portion of the route yield a chordal error within a chordal error threshold; and determine a spacing for locations in the route such that for a track segment having two end points, wherein the two end points comprise two consecutive locations of the plurality of locations, the distance from a point on the segment to a nearest of the two end points is less than the distance from the point to any point on any non-contiguous track segment.

18. The non-transitory computer-readable storage medium of claim 14, wherein the instructions that cause the computer to process the converted survey data comprises instructions that cause the computer to:

identify a portion of the survey data in which a first path in the route diverges from a second path;

identify a portion of the survey data where successive locations of the plurality of locations in the route are not listed sequentially;

identify a location of the plurality of locations in the route having a lesser number of route parameters associated therewith than the number of route parameters associated with another location of the plurality of locations; and display the identified data to a user.

* * * * *